United States Patent [19]

Flaherty

[11] Patent Number: 4,669,611

[45] Date of Patent: Jun. 2, 1987

[54] PACKAGE GROUP

[75] Inventor: Kenneth A. Flaherty, Louisville, Ky.

[73] Assignee: Brown & Williamson Tobacco Corporation, Louisville, Ky.

[21] Appl. No.: 830,318

[22] Filed: Feb. 18, 1986

[51] Int. Cl.[4] ..... B65D 75/00

[52] U.S. Cl. ..... 206/442; 206/459; 206/602; 40/486

[58] Field of Search ..... 206/427, 432, 442, 459, 206/497, 602; 40/312, 486

[56] References Cited

U.S. PATENT DOCUMENTS

| | | | |
|---|---|---|---|
| 2,568,427 | 9/1951 | Wolowitz | 206/459 |
| 2,973,128 | 2/1961 | Leone | 206/602 |
| 3,155,234 | 11/1964 | Knoll et al. | 206/459 |
| 3,221,876 | 12/1965 | Currie | 206/602 |
| 3,711,683 | 1/1973 | Hamisch, Sr. | 40/486 |
| 3,809,227 | 5/1974 | Begemann | 206/459 |
| 4,077,516 | 3/1978 | Duerr | 206/602 |
| 4,533,052 | 8/1985 | Fruchey et al. | 206/602 |

*Primary Examiner*—William Price
*Assistant Examiner*—Brenda J. Ehrhardt
*Attorney, Agent, or Firm*—Charles G. Lamb

[57] ABSTRACT

A package group comprising at least two individual packages fastened together in stacked, registered superimposed relationship by a wrap around band. The wrap around band is adhesively attached to two adjacent sides of the package group symmetrically with the interface between the two packages of the group. Each package has a pricing bar code on one surface thereof, and the packages are oriented so that the surface of each package having the bar code face to the same side of the package group. The wrap around band is fabricated of a transparent material and includes an opaque panel asymmetrically located to one side of the longitudinal centerline of the band. The opaque panel is positioned, sized and configured to completely cover the pricing bar code on only one of the packages of the group.

2 Claims, 2 Drawing Figures

PACKAGE GROUP

BACKGROUND OF THE INVENTION

The present invention relates to the field of packaging, and more particularly to forming a group of two or more individual packages fastened together.

It is known to form groups of two or more packages for convenient marketing purposes. Conventional cartons of cigarette packages typically including ten individual packages are but one example.

Various other examples are disclosed in U.S. Pat. No. 2,888,132 issued on May 26, 1959 to Guyer; U.S. Pat. No. 2,920,759 issued on Jan. 12, 1960 to Carnes; and U.S. Pat. No. 3,148,768 issued on Sept. 15, 1964 to Gatto. Further, U.S. Pat. No. 4,068,028 issued on Jan. 10, 1978 to Samonides; and U.S. Pat. No. 4,479,316 issued on Oct. 30, 1984 to Wippern each disclosed adhesive-backed labels for attachment to, for example, packages.

It has become a popular marketing technique to offer, for example, "two for the price of one" product sales. It is also typical to attach the two packages containing the product on sale together for convenience.

The advent of pricing bar codes on product packages for automatic recording of sales has, however, presented a problem to the attaching of product packages together into groups for these type of sales. The problem basically is that the automatic bar code reading equipment will read and register the pricing bar codes on each of the packages of the group on sale. This will result in either a confusing signal registered by the code reading equipment as it attempts to concurrently read and register two bar codes, or will cause the code reading equipment to register the price for both packages of the group ignoring the fact that the price of one of the two packages should not be registered.

SUMMARY OF THE INVENTION

The present invention recognizes the above described problems and provides a solution which is straightforward and relatively inexpensive.

More particularly the present invention provides a package group comprising two packages positioned in stacked, registered superimposed relationship, each packaging having a pricing bar code on one surface facing to the same side of the package group, a wrap around band adhesively attached to at least two adjacent sides of the package group symmetrically with the interface between the two packages of the group connecting the packages together, one of the sides of the sides of the group being that side formed of the surfaces of the two packages having the pricing bar code, the wrap around band being fabricated of a transparent material, and the wrap around band having an opaque panel asymmetrically located to one side of the longitudinal centerline of the band positioned, sized and configured to completely cover the pricing bar code on only one of the packages of the group.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
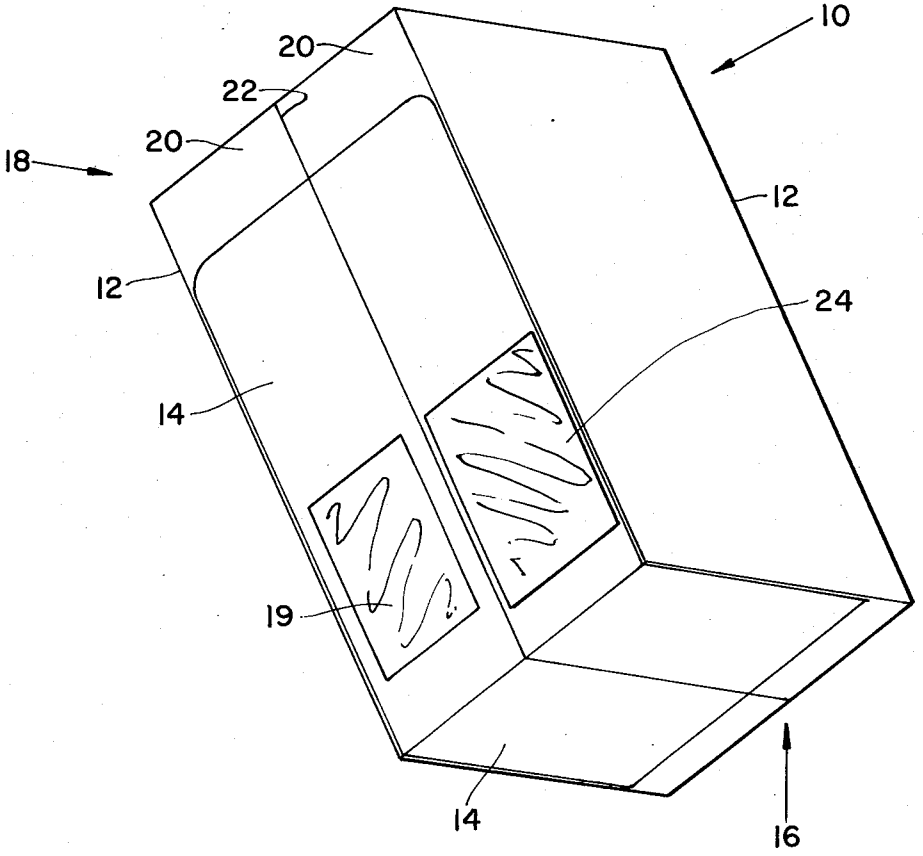
FIG. 1 is a perspective view of the package group of the present invention; and, FIG. 2 is a perspective partially exploded view of the package group of FIG. 1.
Figure 2:
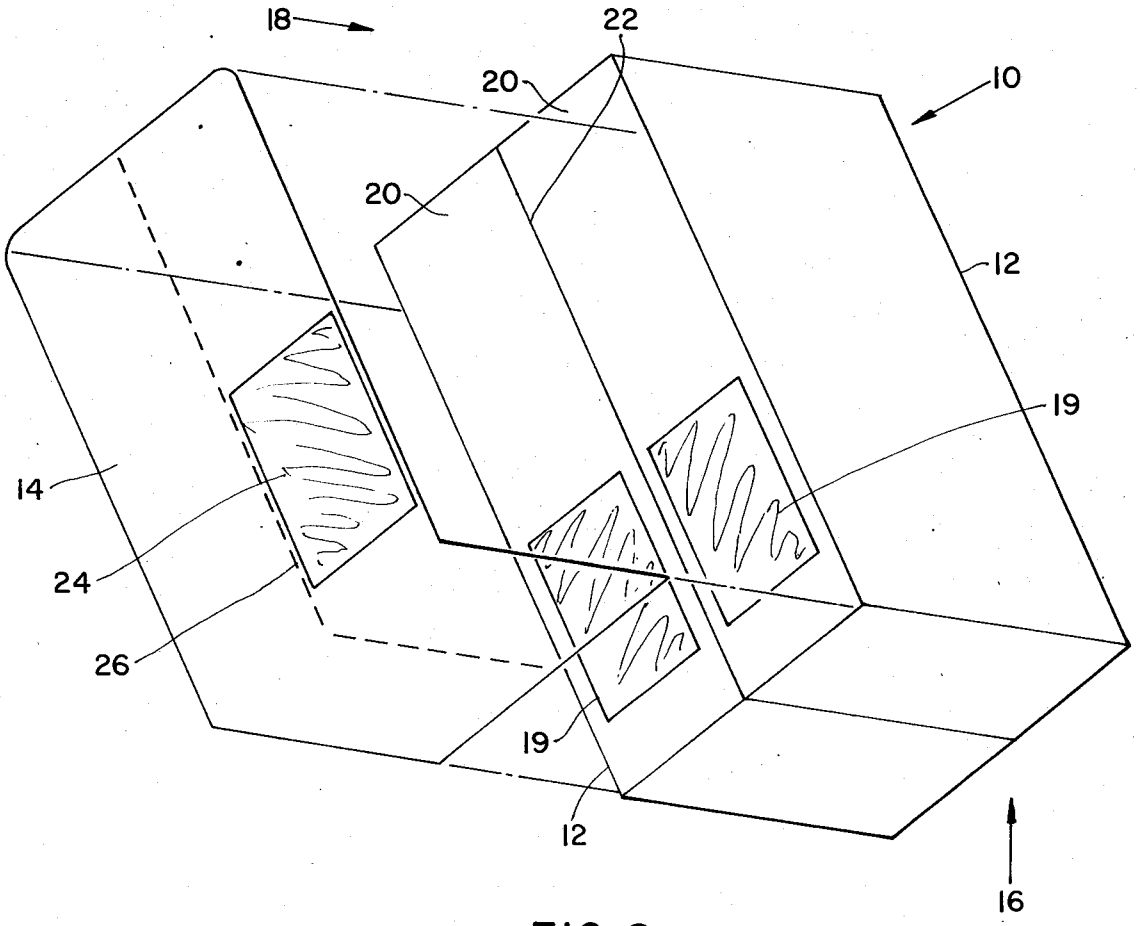

With reference to FIGS. 1 and 2, there is shown a package group, generally denoted as the numeral 10, of the present invention. The package group 10 is formed of two identical individual packages 12 positioned in stacked, registered, superimposed relationship attached together by a wrap around band 14 adhesively fastened to two adjacent sides 16 and 18 of the package group 10.

Each of the two individual packages 12 has a pricing bar code 19 on one package surface 20 facing to the same side 18 of the package group 10.

The wrap around band 14 is symmetrically located with the interface 22 between the two packages 12 of the package group 10, one of the sides 18 of the group being that side formed of the package surface 20 of the packages 12 having the pricing bar code 19 such that the bar codes 19 are located in aligned side-by-side relationship to each side of the package interface 22.

The wrap around band 14 is fabricated of a transparent, flexible material having an adhesive on the side thereof placed against the packages 12. The wrap around band 14 includes an opaque panel 24 located to one side of the longitudinal centerline of the band 14. The opaque panel 24 is positioned, sized and configured to completely cover the pricing bar code 16 on only one of the packages 12 of the group 10 leaving the bar code 19 of the other one of the packages 12 visible through the transparent band 14.

The wrap around band 14 also includes a line of perforations 26 extending longitudinally of the band 14 from one end to the other end thereof on the longitudinal centerline of the band 14. Therefore, the line of perforations 26 overlays the interface 22 of the packages 12.

The package group 10 of the present invention makes it convenient to use the automatic bar code reading apparatus with the assurance that the bar code 19 of only one package will be read providing for the accurate recording of the sale price of the package group 10. In addition, the line of perforations 26 allows the purchaser to easily separate the packages 12 after the purchase has been made.

The foregoing description is given primarily for clearness of understanding and no unnecessary limitations should be understood therefrom for modifications will become obvious to those skilled in the art upon reading this disclosure and may be made without departing from the spirit of the invention and scope of the appended claims.

What is claimed is:

1. A package group comprising:

at least two packages located in stacked, registered superimposed relationship, each package having a pricing bar code on one surface facing to the same side of the package group;

a wrap around band adhesively attached to at least two adjacent consecutive sides of the package group symmetrically with the interface between the two packages of the group connecting the packages together, one of the sides of the group being that side formed of the surfaces of the two packages having the pricing bar code, the wrap around band being fabricated of a transparent material; and the wrap around band having an opaque panel asymmetrically located to one side of the longitudinal centerline of the band positioned, sized and configured to completely cover the pricing bar code on only one of the packages of the group.

2. The package group of claim 1, wherein the wrap around band comprises means defining a line of perforations extending longitudinally of the band from one end to the other end thereof on the longitudinal centerline of the band such that the line of perforations is overlaying the interface between the packages.

* * * * *